United States Patent [19]

Toeppen

[11] 4,294,370

[45] Oct. 13, 1981

[54] THREADED CLOSURE AND CONTAINER

[76] Inventor: Thurston H. Toeppen, Lois La. R.D. 3, Poughkeepsie, N.Y. 12603

[21] Appl. No.: 133,536

[22] Filed: Mar. 24, 1980

[51] Int. Cl.[3] ..... B65D 41/04

[52] U.S. Cl. ..... 215/329; 220/304

[58] Field of Search ..... 215/329; 220/288, 289, 220/304

[56] References Cited

U.S. PATENT DOCUMENTS 4,231,480 11/1980 Spransy ..... 215/329

*Primary Examiner*—Donald F. Norton

*Attorney, Agent, or Firm*—Kane, Dalsimer, Kane, Sullivan and Kurucz

[57] ABSTRACT

A screw-type closure molded of resilient plastic is provided with an internal thread having a smaller axial pitch spacing than the mating external thread of the container with which it is used, the difference between the two threads being designed to compensate for a number of variables affecting sidewall characteristics around the circumference of the closure, in order to secure more uniform application of sealing pressure and other advantages.

5 Claims, 2 Drawing Figures

THREADED CLOSURE AND CONTAINER

BACKGROUND OF THE INVENTION

Screw-type closures molded of resilient plastic materials such as polyethylene or polypropylene have been widely used for sealing metal, glass, and plastic containers holding a variety of products. However, closures of this type have been of limited practicability for liquids under pressure, such as carbonated beverages. This limitation is due not only to the permeability of the pliable materials used, and to the unavoidable inaccuracies of the mating parts, both of which become more critical with increasing pressure, but may also be the unwanted side-effect of some efforts to improve pressure retention. For example, screwing the closure more tightly onto the container may deform the thread so much that it will be difficult for the user to unscrew. In addition it may cause distortion of the closure, due to unbalanced loading of the screw thread, to the point where leakage is actually increased.

Separate sealing materials have sometimes been added to a basic closure to improve these conditions, but they add substantially to the cost. Also, many types of integrally-molded sealing lips have been designed for incorporation into the body of the closure, with the aim of reducing leakage. Some of these seal designs are arranged to bear on the inside or the outside of the rim of the container opening, in which case the amount of sealing pressure which can consistently be applied to them is restricted by the tensile strength and resilience of the material used, and by the unavoidable dimensional variations of the mating parts. Others are arranged to bear on the top surface or edges of the container rim. In this approach, the characteristics of the material and the dimensional variations of the parts are less critical, owing to the accommodative ability of the screw thread, but the sealing action becomes more sensitive to any distortion or cocking of the closure. It is this condition which the present invention is principally designed to improve.

In the conventional construction there is an inherent tendency toward distortion and cocking, due to the fact that both the closure and container threads always have the same axial pitch spacing. Such exact matching may be correct practice in ordinary situations, but it results in uneven stresses when one of the mating parts is substantially more pliable than the other. In the case of resilient plastic closures for pressurized applications, the thread is formed on a body of relatively pliable material, whereas the mating container thread is much more rigid. As a result, the point of thread contact nearest the seal elements receives a substantially greater proportion of the sealing load than the one farthest away, the load on which is weakened by stretching of the additional plastic material above it. Between these two limits, there is a gradual reduction of the load assumed by each portion of the thread. The net result is that the portion of the seal directly above the topmost contact point is compressed more heavily than desirable, while other portions of the seal are compressed more lightly. This results in a tendency for the closure to tilt. It may also lead to jamming of the thread at the highest point of contact during installation, and in extreme cases to distortion or rupture of the plastic wall. These conditions in turn may lead to difficulty in manually removing the closure from the container.

SUMMARY OF THE INVENTION

A closure according to the invention is provided with an internal thread having a smaller axial pitch spacing than the mating external thread of the container, the difference between the two threads being designed to compensate for the normal variations in sidewall characteristics around the circumference of the closure. This will result in the more uniform application of axial sealing pressure at all points around the circumference of the sealing element, or elements, thereby maximizing the effectiveness of the closure seal and minimizing the influence of manufacturing irregularities.

The principal object of the invention is to provide improved sealing of resilient plastic screw-type closures when used in combination with relatively rigid containers.

Another object of the invention is to facilitate installation of the closure on the container by distributing thread friction more uniformly over the entire area of thread contact, in order to provide more consistent installation torque and to prevent localized stress concentrations which may lead to jamming of the thread and/or damage to the plastic.

Another object of the invention is to facilitate manual removal of the closure by preventing localized stress concentrations during installation and storage, which may so deform the closure thread as to impede the unscrewing operation.

DESCRIPTION OF THE PREFERRED EMBODIMENTS

Figure 1:
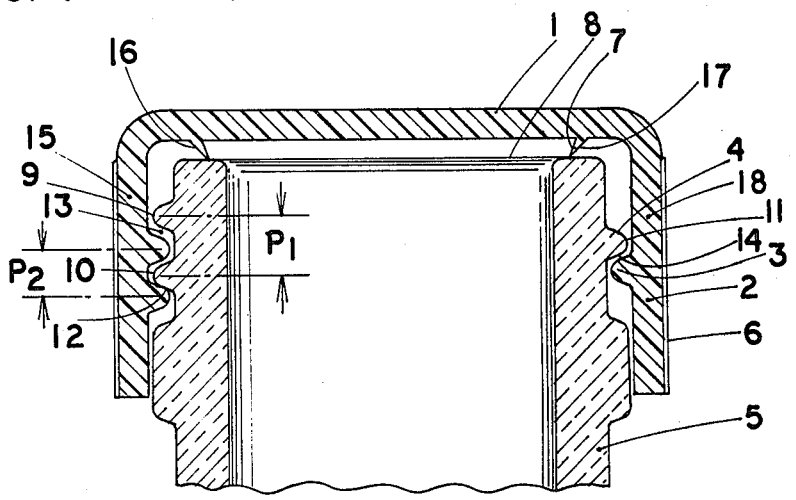
FIG. 1 is a sectional side view of the central plane of a typical glass container top with a closure according to the invention, the closure being screwed down only to the point where its sealing element just makes contact with the surface of the container rim as the closure thread just makes working contact with the container thread.

As shown in FIG. 1, the invention is embodied in a plastic, screw-type closure molded of polyethylene, polypropylene, or a similar resilient plastic. The closure comprises a circular crown 1, a cylindrical sidewall or skirt 2 which is integral with the crown, an internal screw thread 3 to mate with a corresponding external thread 4 which is part of container 5, and external knurls or flutes 6 by which it may be gripped to rotate it on to or off of the container thread. One or more circular sealing elements is provided, such as lip 7, to bear on the mating top surface 8 of the container. Alternatively, the sealing element may consist of a raised bead or a shoulder, and may bear on the inner or outer corner of surface 8, or on both.

Container 5 is of a conventional style, and may correspond to any of a number of designs which have been standardized by agencies of the container industry. As shown in FIG. 1 it has the general conformation of a glass container, but may equally well be made of plastic or metal.

Figure 2:
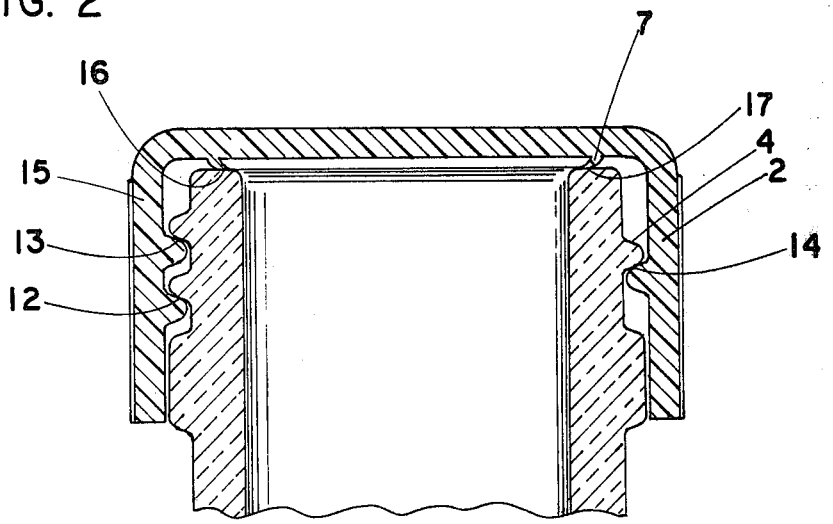
FIG. 2 is a similar sectional side view, the same as FIG. 1 except that the closure has been screwed home so that the seal is fully deflected and the threads fully loaded.

In order to best illustrate the principles of the invention, thread 4 in the figures is shown as if it consisted of exactly one turn, with the upper end 9 and lower end 10 of the thread shown at the left side of FIG. 1, and the midpoint 11 of the thread shown in section at the right side. In practice, such threads are usually longer; however, the principles of the invention are most clearly shown in the single-turn example. Thread 3 is understood to be long enough to provide full contact with thread 4 as the closure is rotated from the position of FIG. 1 to that of FIG. 2.

The axial spacing between successive turns of the same thread is known as the pitch, and is usually expressed either as the equivalent number of turns per inch or, conversely, as a certain fraction of an inch per turn. For example, a thread pitch equivalent to eight turns per inch would have an axial spacing between turns of one-eighth of an inch.

Referring to the left side of FIG. 1, the axial pitch of the container thread is indicated by the dimension $P_1$, and the slightly smaller pitch of the closure thread by the dimension $P_2$. Since the closure of FIG. 1 is shown just at the stage in its rotation where the thread makes working contact with the container thread at point 12, the pitch difference between $P_1$ and $P_2$ will appear as an axial clearance at point 13. At the halfway point 14 of the thread turn, the axial clearance is half of that at 13. In FIG. 1, the clearances are exaggerated to emphasize the principles.

As the closure is rotated beyond the stage shown in FIG. 1, thread 3 is forced downward at point 12 by the inclination of thread 4, thereby placing zone 15 of sidewall 2 in axial tension, and compressing area 16 of seal 7 against surface 8. However, the tension in zone 15 also operates in the opposite direction, immediately causing the contact area at point 12 to spread out and extend toward point 14 on account of the resilience of the plastic material. As the closure is tightened, the stretching of sidewall 2, the compression of seal 7, and the extension of the thread contact area all progress together around the closure, past point 14, until the progression has completed the full turn at point 13, to reach the condition shown in FIG. 2. At that stage, if the difference between $P_1$ and $P_2$ has been correctly proportioned, the thread contact pressure per unit of contact length, the tension per unit in the sidewall above the thread, and the seal pressure per unit of contact length, will all be uniform around the closure. To express it in more general terms, the amount of divergence of the threads is designed to compensate for the changes in the effective length of the sidewall around the closure. Any additional tightening of the closure will increase all of the forces involved, but without significantly changing their relationship or their uniformity.

The exact amount of thread divergence required between $P_1$ and $P_2$ will vary according to the pitch of the container thread, the dimensions of the sidewall in the thread area, and the tension modulus, or extensibility, of the particular plastic used for the closure. It will also vary with the material and thickness of the container, but this effect is ordinarily so small that it can be neglected.

The principle of the invention may be more evident if it is pointed out that in the case of a conventional closure thread design, $P_2$ would be the same as $P_1$, so that under the conditions of FIG. 1 the clearances at points 13 and 14 would be zero. Consequently, the closure thread would make initial contact with the container thread at the same time along its entire length. Further rotation of the closure would then begin to apply equal increments of downward movement to each portion of the thread around the closure. However, at point 13 this increment would be transmitted to the corresponding point 16 of the seal by way of a relatively short length of sidewall at 15, whereas the same increment of downward movement at point 14 would be transmitted to its corresponding point 17 of the seal by way of a relatively longer length of sidewall at 18. The greater length of sidewall stretch between points 14 and 17, for the same amount of thread movement, would of course result in a lower sealing pressure at 17.

The same effect would become even more pronounced on moving down the thread toward point 12, until the nearness of point 13 would cause a rapid shift in the pressure distribution back to the maximum. The thread at point 12 itself would be sheltered by point 13, and would take very little of the load. It is evident that the "sawtooth" pressure pattern produced by this combination of conditions, with its concentration of sealing force about point 13, a gradual weakening around the circle through point 14, and a sudden rise again near point 12, would result in tendencies toward weaker sealing at certain points, overloading of the thread at point 13, and underloading of the thread near point 12.

I claim:

1. A closure device of resilient material, in combination with a container having an external screw thread of less resilient material, comprising: a circular crown disc, a cylindrical sidewall or skirt depending from said disc and perpendicular to it, an internal screw thread within said sidewall to mate with said external screw thread, and sealing means integral with the inside surface of said crown disc for mating contact with the upper rim of the opening of said container; said internal thread having an initial axial pitch shorter than the initial axial pitch of said external thread by an amount proportional to the difference in the effective elasticities of said materials and to the axial pitch of said external thread.

2. A closure device as in claim 1, in which said initially-different axial pitches of said threads become effectively equal after final installation of closure and concomitant deflections of said threads.

3. A closure device as in claim 1, in which the final axial pressure per unit of contact length between said sealing means and said upper rim is substantially equal around the circumference of said closure.

4. A closure device as in claim 1, in which the final axial pressure per unit of contact length between said threads is substantially equal around the circumference of said closure.

5. A closure device as in claim 1, in which the final axial tension per unit of cross-section area in said sidewall, between said internal thread and said seal, is substantially equal around the circumference of said closure.

* * * * *